US005281795A

United States Patent [19]

Harlan

[11] Patent Number: 5,281,795

[45] Date of Patent: Jan. 25, 1994

[54] VOTE RECORDING DEVICE

[75] Inventor: Russell F. Harlan, Citrus Heights, Calif.

[73] Assignee: Computer Election Corporation, San Francisco, Calif.

[21] Appl. No.: 176,676

[22] Filed: Apr. 1, 1988

Related U.S. Application Data

[63] Continuation-in-part of Ser. No. 41,690, Apr. 23, 1987, abandoned.

[51] Int. Cl.[5] ..... G07C 13/00

[52] U.S. Cl. ..... 235/50 A; 83/684

[58] Field of Search ..... 235/50 R, 50 A, 50 B, 235/54 R, 55 R; 83/687, 684, 686; 225/93; 402/1

[56] References Cited

U.S. PATENT DOCUMENTS

| | | | |
|---|---|---|---|
| 1,613,766 | 1/1927 | Parcher | 83/687 |
| 3,240,409 | 3/1966 | Harris | 225/93 |
| 3,536,257 | 10/1970 | Laws | 235/50 B |
| 4,297,566 | 10/1981 | Ahmann | 235/50 R |
| 4,488,034 | 12/1984 | Stephens et al. | 235/50 B |
| 4,504,735 | 3/1985 | Thayne | 235/50 A |
| 4,708,560 | 11/1987 | Abildgaard et al. | 402/1 |

*Primary Examiner*—David M. Gray

*Attorney, Agent, or Firm*—Jerry T. Kearns

[57] ABSTRACT

A vote recording device utilizes a punch to form machine readable holes at preselected locations in a non-scored paper ballot card. A stationary top mask with an array of spaced punch access apertures and a metal anvil plate with an array of spaced die apertures are secured within a housing in spaced parallel relation with the apertures in axial alignment. A lockout template having an array of spaced punch receiving apertures is received for sliding movement between the top mask and the anvil plate. The lockout template is biased to a position where the punch receiving apertures on the lockout template are out of alignment with the punch access apertures in the upper mask. A ballot card is inserted between the lockout template and the anvil plate, causing the lockout template to slide to a position in which the punch receiving apertures of the lockout template are in alignment with the punch access apertures in the upper mask and the die apertures in the anvil plate. A punch has a fixed cutting stylus with axially offset curved cutting edges for forming a clean hole in the ballot card by a progressive shearing action. The cutting stylus is received within an axially sliding spring biased guide sleeve dimensioned to be inserted into the punch access apertures of the top mask and the punch receiving apertures of the lockout template.

14 Claims, 4 Drawing Sheets

VOTE RECORDING DEVICE

RELATED APPLICATIONS

This application is a Continuation-in-Part of copending application Ser. No. 41,690, filed Apr. 23, 1987, abandoned.

BACKGROUND OF THE INVENTION

1. Field of the Invention

The present invention relates to vote recording devices, and more particularly pertains to a new and improved punch type vote recording device which punches machine readable holes in non-scored ballot cards. Conventional vote recording devices require the use of a paper ballot card provided with a large number of discrete prescored portions which may be punched out by a blunt stylus to form a rectangular opening in the card. The ballot cards are later read in a machine card reading device. These conventional vote recording devices which utilize prescored ballot cards are disadvantageous because the scored portion punched out by the blunt stylus, sometimes referred to as a "chip" or a "chad", may not be fully removed but merely folded downwardly on the ballot card with one edge still remaining attached to the ballot. When the ballot card bearing such attached chips enters the card reading machine, it disrupts the proper scanning or operation of the machine. Additionally, the prescored portions of the ballot card may become accidentally loose or removed, thus resulting in incorrect or defective ballots. In order to overcome these problems, the present invention provides an improved vote recording device adapted to form clean openings in a non-scored ballot card.

2. Description of the Prior Art

Various types of vote recording devices are known in the prior art. A typical example of such a vote recording device is to be found in U.S. Pat. No. 3,536,257, which issued to I. Laws on Oct. 27, 1970, and U.S. Pat. No. 4,297,566, which issued to Ahmann on Oct. 27, 1981. These devices disclose voting systems utilizing prescored ballot cards. These patents additionally describe the inherent disadvantages of voting systems utilizing prescored cards. U.S. Pat. No. 4,488,034, which issued to R. Stephens et al on Dec. 11, 1984, discloses a voting system which utilizes unscored ballot cards. This device employs a sharpened cutting stylus and places the unscored ballot card directly over an anvil plate which is provided with an array of spaced die openings corresponding to the diameter of the stylus and in alignment with guide openings provided in an upper mask through which the punch must be inserted. The cutting tip of the stylus has an angled end portion formed with a recessed center section for severing a chip from the card. A resilient sheet is positioned beneath the template and is provided with pairs of cross-slits intersecting at the axis of each opening, through which the stylus is pressed, by spreading apart the quadrants of the cross-slits at the opening, for stripping the chips from the end of the stylus. This device employs an upper mask, an intermediate template and a bottom template which is biased out of alignment with the apertures formed in the upper mask. The intermediate template serves as a mechanical lockout device which prevents the insertion of a stylus unless a ballot card is fully seated in the device. The seating of the ballot card causes axial shifting of the intermediate template which axially aligns openings of the upper mask, intermediate template and bottom template, allowing insertion of the cutting stylus. In the device of Stephens et al, the upper mask moves in response to insertion of a ballot card. This is undesirable because it provides a voter with access to the mask and additionally is subject to accidental contact by the user during even slight hand movement while holding the stylus.

While the above mentioned device of Stephens et al provides a system which does not require the use of prescored ballot cards, the system disclosed therein has certain drawbacks and disadvantages which are overcome by the vote recording device of the present invention. For example, because each of the upper mask, intermediate template and lower anvil of Stephens et al have openings of the same diameter, and since it is necessary for the stylus to be inserted freely and easily through the upper mask, in the event the ballot card is not fully or properly seated and the intermediate template is slightly askew, the entry of the stylus may cause the template to shift and register a punch on a misaligned ballot card. Further, the slot required between the intermediate template and the bottom anvil must be sufficiently wide to permit insertion of the ballot card and must be at least as wide as the thickest anticipated card to be utilized. Accordingly, there is little support for the card in immediate surrounding relation to the bottom anvil hole, and since the card is not firmly supported against the bottom anvil during the punching step, it is possible to form a ragged edge hole in the ballot card which may produce scanning errors during machine reading. A further disadvantage of the voting system proposed by Stephens et al is the fact that the cutting stylus tip has extremely sharp exposed cutting edges which create the potential for serious injury to a voter. Inasmuch as the art is relatively crowded with respect to these various types of vote recording devices, it can be appreciated that there is a continuing need for and interest in improvements to such vote recording devices, and in this respect, the present invention addresses this need and interest.

SUMMARY OF THE INVENTION

In view of the foregoing disadvantages inherent in the known types of vote recording devices now present in the prior art, the present invention provides an improved vote recording device. As such, the general purpose of the present invention, which will be described subsequently in greater detail, is to provide a new and improved vote recording device which has all the advantages of the prior art vote recording devices and none of the disadvantages.

To attain this, a representative embodiment of the concepts of the present invention is illustrated in the drawings and makes use of a non-scored paper ballot card. A housing has a stationary top mask with an array of spaced punch access apertures. A metal anvil plate is secured within the housing in spaced parallel relation beneath the top mask. An array of spaced die apertures are formed in the anvil plate in alignment with the punch access apertures of the top mask. A lockout template having an array of spaced punch receiving apertures is received for sliding movement between the top mask and the anvil plate. The lockout template has a downwardly extending end wall which is biased by a leaf spring to a position where the punch receiving apertures on the lockout template are out of alignment with the punch access apertures in the upper mask. A non-scored paper ballot card is inserted through a slot into a space between the lockout template and the anvil plate. Insertion of the ballot card forces the end wall of the lockout template against the bias of the leaf spring to a position in which the punch receiving apertures of the lockout template are in alignment with the punch access apertures in the upper mask and the die apertures in the anvil plate. A pair of alignment pins are provided on an inclined inlet ramp portion of the housing. These alignment pins engage preformed holes in the ballot card for ensuring proper registry of the ballot card with the top mask. A punch has a fixed cutting stylus with axially offset curved cutting edges for forming a clean hole in the ballot card by a progressive shearing action. The cutting stylus is received within an axially reciprocal guide sleeve which is spring biased to a position enclosing the cutting end of the stylus. The guide sleeve is dimensioned to be inserted into the punch access apertures of the top mask and the punch receiving apertures of the lockout template. In use, the end of the sleeve presses the ballot card against the anvil plate while the end of the cutting stylus is forced through the ballot card and through the aligned die opening in the anvil plate.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved vote recording device which has all the advantages of the prior art vote recording devices and none of the disadvantages.

It is another object of the present invention to provide a new and improved vote recording device which may be easily and efficiently manufactured and marketed.

It is a further object of the present invention to provide a new and improved vote recording device which is of a durable and reliable construction.

An even further object of the present invention is to provide new and improved vote recording device which is susceptible of a low cost of manufacture with regard to both materials and labor, and which accordingly is then susceptible of low prices of sale to the consuming public, thereby making such vote recording devices economically available to the buying public.

Still yet another object of the present invention is to provide a new and improved vote recording device which provides in the apparatuses and methods of the prior art some of the advantages thereof, while simultaneously overcoming some of the disadvantages normally associated therewith.

Still another object of the present invention is to provide a new and improved vote recording device which enables the use of non-scored ballot cards.

Yet another object of the present invention is to provide a new and improved vote recording device which utilizes an improved punch with a cutting stylus protected in a sleeve and provided with axially staggered curved cutting edges for forming clean cut holes in a non-scored ballot card by a progressive shearing action.

Even still another object of the present invention is to provide a new and improved vote recording device which utilizes a punch having a stylus within an axially reciprocal sleeve with a bottom end surface of the sleeve acting as a clamp for holding the ballot card against an underlying anvil plate during a progressive shearing action of the cutting stylus.

An additional object of the present invention is to provide a new and improved vote recording device which prevents a hole from being punched in a ballot card when the ballot card is not located in proper alignment.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
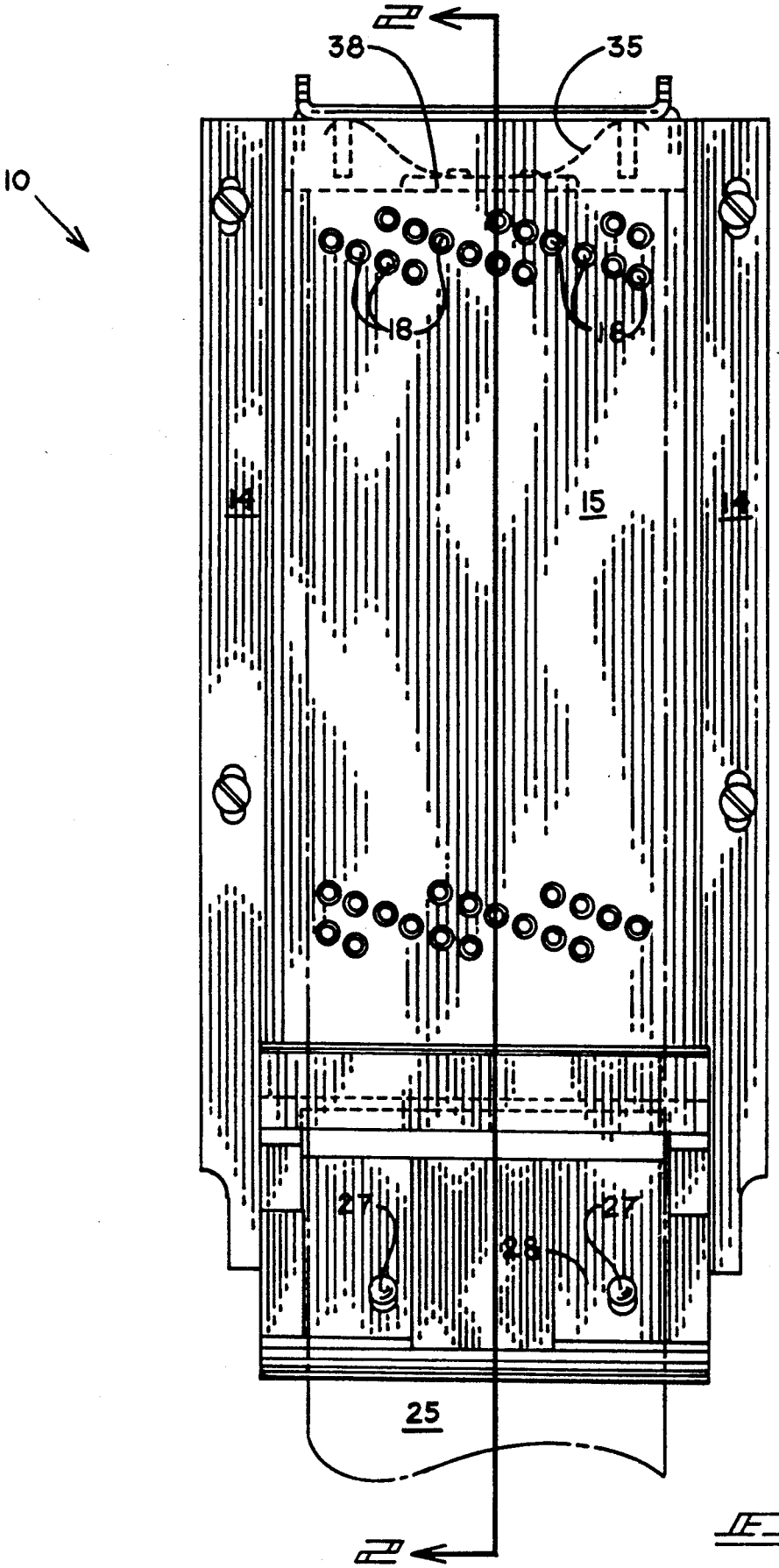
FIG. 1 is a top plan view of the vote recording device of the present invention.

With reference now to the drawings, and in particular to FIG. 1 thereof, a new and improved vote recording device embodying the principles and concepts of the present invention and generally designated by the reference numeral 10 will be described.

More specifically, it will be noted that the vote recording device 10 of the invention includes a top mask 15 provided with an array of spaced circular punch access apertures 18. The top mask 15 is supported in a housing provided with mounting flanges 14 provided with spaced slots for the reception of conventional threaded fasteners. A pair of alignment pins 27 are formed on an inclined inlet ramp 28 as shown adjacent the left hand portion of FIG. 1.

Figure 2:
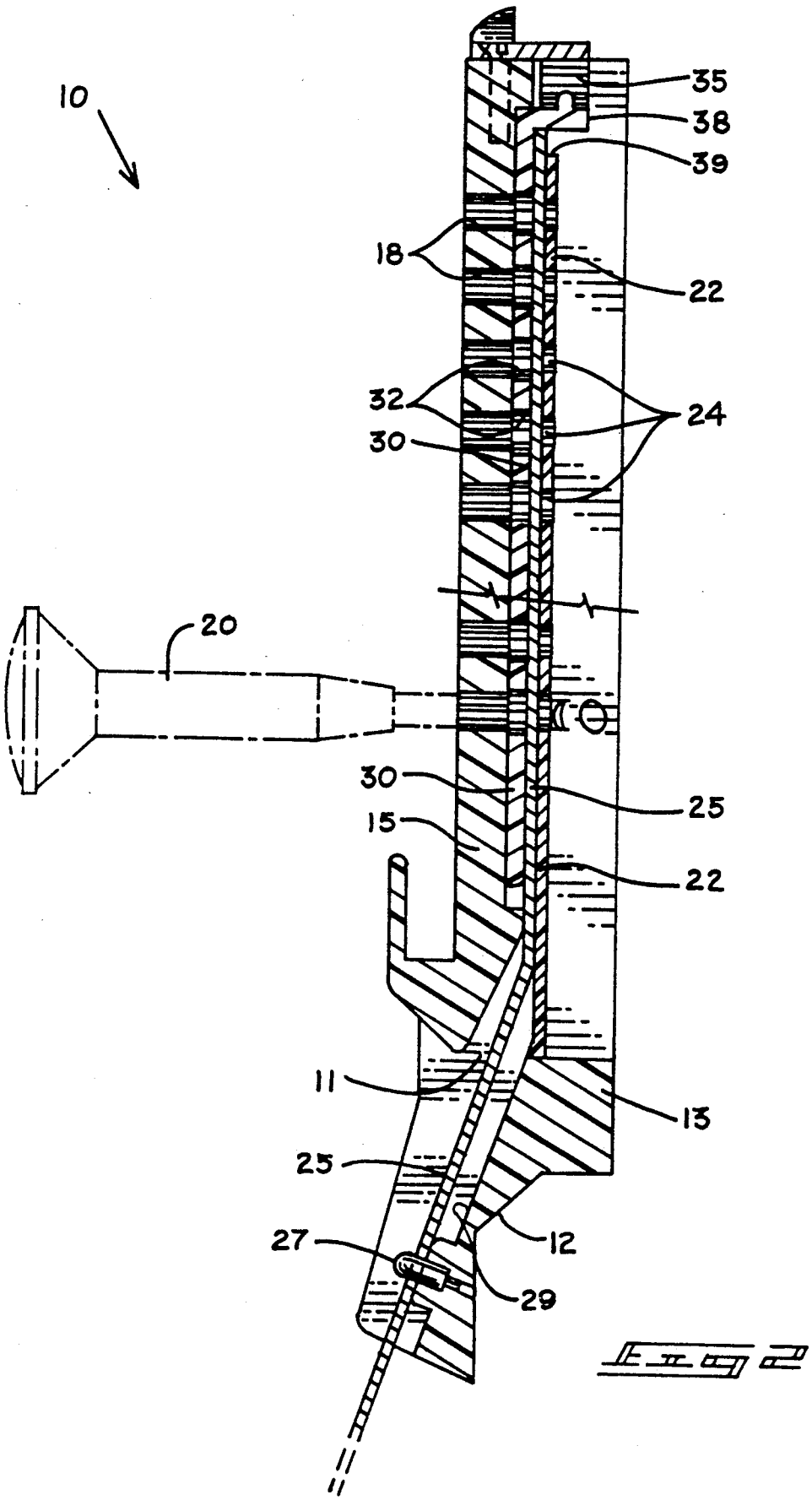
FIG. 2 is a longitudinal cross sectional view of the vote recording device of the present invention, taken along line 2—2 of FIG. 1.
Figure 3:
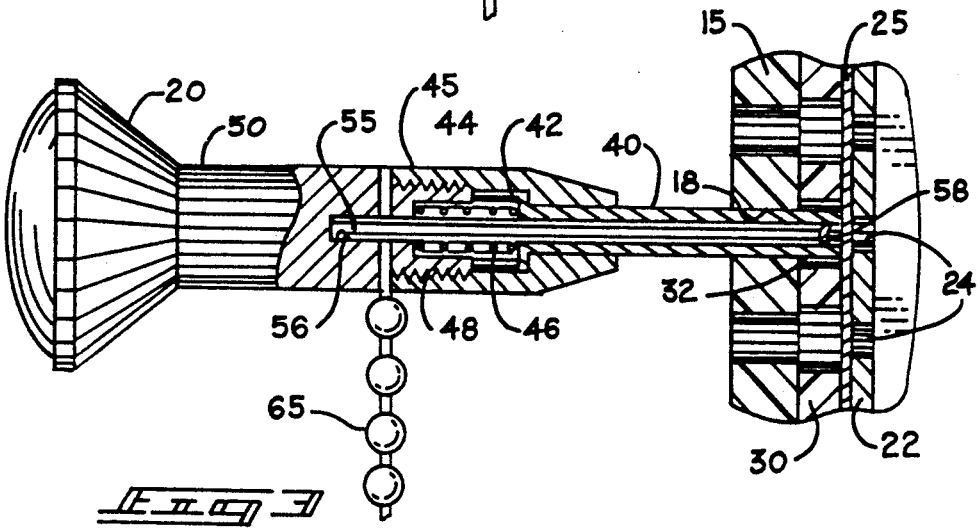
FIG. 3 is an enlarged cross sectional detail view illustrating the punch inserted in proper orientation prior to actuation of the cutting stylus.

With reference now to FIG. 2, a cross sectional view taken along line 2—2 of FIG. 1, the construction of the voting device 10 of the present invention will now be further described. The housing 12 is formed with downwardly depending side walls 13 which form a support base. The top mask 15 is supported at the top of the housing 12. An anvil plate 22, having an array of spaced circular die openings 24, is secured within the housing 12 in spaced parallel relation to the top mask 15. The die openings 24 in the anvil plate 22 are in axial alignment with the punch access apertures 18 in the upper mask 15. A lockout template 30 is received for limited sliding movement in the space between the bottom of the top mask 15 and the anvil plate 22. The lockout template 30 is provided with a series of spaced punch receiving apertures 32 which may be moved into axial alignment with the punch access apertures 18 of the top mask 15 and the die openings 24 in the anvil plate 22. The punch receiving apertures 32 have a slightly larger diameter than the punch access apertures 18, to allow free access to the punch sleeve 40 (FIG. 3). This has been illustrated with exaggeration in the drawings for purposes of clarity. The lockout template 30 has a downwardly extending end wall 38 which is biased by a leaf spring 35 to urge the lockout template 30 to the left hand side of FIG. 2. The sliding movement of the lockout template 30 is limited by the spacing between the end wall 39 of the anvil plate 22 and the downwardly extending end wall 38 of the lockout template 30. When a paper ballot card 25 is inserted through a slot 11 into the space between the lockout template 30 and the anvil plate 22, the right hand end edge of the ballot card 25 contacts the end wall 38 of the lockout template 30 and forces the lockout template 30 into the illustrated position, against the bias of the leaf spring 35. The ballot card 25 is provided with preformed alignment apertures through which alignment pins 27 are received. This ensures proper alignment of the ballot card 25. The housing 12 is provided with an inclined surface 29 for purposes of guiding the ballot card 25 into the slot 11. In the illustrated position, the ballot card 25 is inserted in proper alignment between the slidable lockout template 30 and the stationary anvil plate 22. The punch receiving apertures 32 of the lockout template 30 are in axial alignment with the punch access apertures 18 of the top mask 15 and the die openings 24 of the anvil plate 22. This allows holes to be punched out of the ballot card 25 by insertion of a punch 20 through the punch access apertures 18 of the top mask 15.

In FIG. 3, an enlarged detail view of FIG. 2 is provided. The punch 20 has a generally cylindrical shank 50 in which a central cylindrical bore 56 is formed. The shank of an elongated metal cutting stylus 55 is fixed within the central bore 56 in the shank 50 of the punch 20. A hollow tubular sleeve 40 is received around the stylus 55. The upper end of the sleeve 40 is provided with a radially outwardly extending annular flange 42 which is received for axial sliding movement within an enlarged bore 44 in the shank 45. A coil spring 46 received around the stylus 55 abuts the flange 42 and urges the sleeve 40 downwardly, to the illustrated position. For purposes of assembly, the shank 50 of the punch 20 has a two piece construction with a threaded lower end 48 of the upper shank portion secured by cooperating threads within a lower shank portion 45. A ball retaining chain 65 is secured to the punch 20 for preventing voters from absconding with the punch 20.

In FIG. 3, the ballot card 25 is positioned in proper alignment between the anvil plate 22 and the lockout template 30. Thus, the punch access apertures 18 of the top mask 15 are in axial alignment with the punch receiving apertures 32 of the lockout template 30 and the die openings 24 of the anvil plate 22. The sleeve 40 is dimensioned to slide with relatively close engagement into the punch access apertures 18. The punch receiving apertures 32 of the lockout template 30 are slightly larger than the apertures 18. When in proper alignment, the bottom end surface of the punch sleeve 40 abuts the upper surface of the ballot card 25, and is positioned in coaxial relation around the die opening 24 in the anvil plate 22. This serves to clamp the ballot card 25 firmly against the anvil plate 22.

Figure 4:
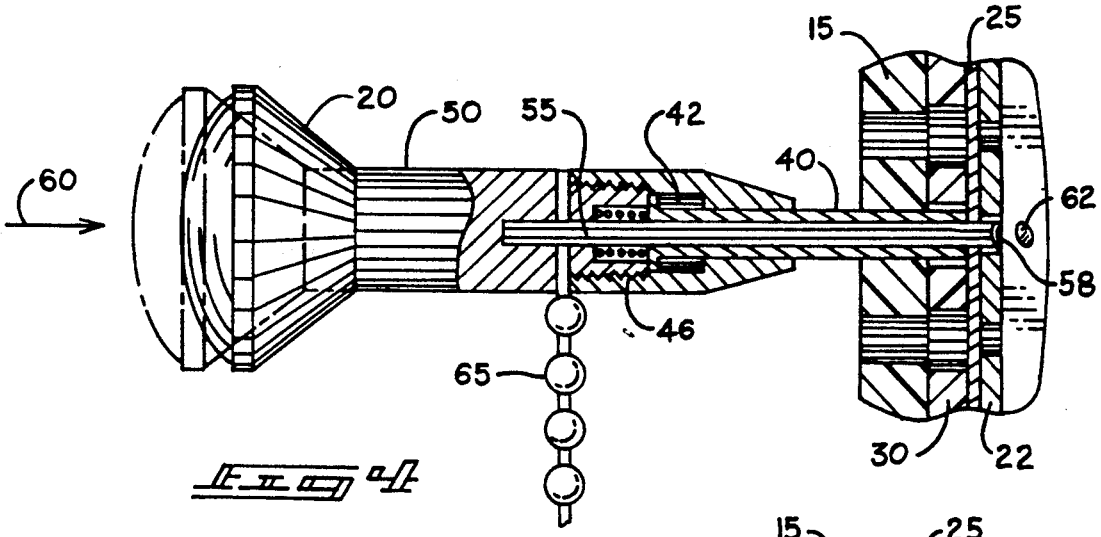
FIG. 4 is an enlarged partial cross sectional view illustrating the relative position of the elements immediately following actuation of the punch to form a cutout in the ballot card.

With reference now to FIG. 4, the manner of actuation of the punch 20 to punch a machine readable hole in a ballot card 25 will now be described. A downward axial force, as indicated by the arrow 60, is applied to the top end of the punch 20. This causes the shank 50 of the punch to be urged downwardly against the bias of the spring 46 until the annular ledge 42 of the sleeve 40 is in engagement with the internal abutment formed by the bottom end of the top portion of the shank 50. This causes the fixed cutting stylus 55 to be projected downwardly, forcing the cutting tip 58 of the stylus 55 out through the bottom end of the sleeve 40 through the ballot card 25 and the die opening 24. The cutting tip 58 shears a cleanly cut circular chip 62 from the ballot card 25.

Figure 5:
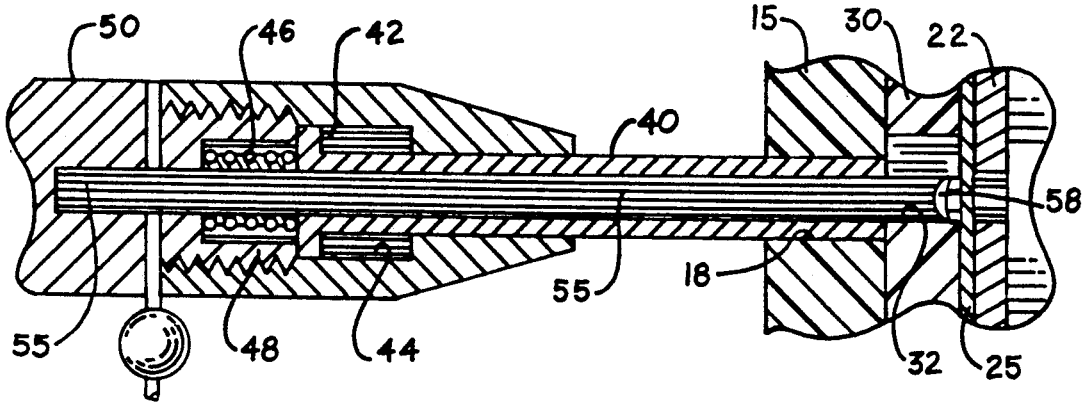
FIG. 5 is an enlarged cross sectional view, illustrating the lockout features of the present invention with respect to a misaligned ballot card.

In FIG. 5, a partial cross sectional view enlarged detail view is provided which illustrates the relative position of the lockout template 30 and the top mask 15 when the ballot card 25 is slightly out of alignment. In this position, the bottom end of the sleeve 40 abuts the upper surface of the lockout template 30. Even though the cutting tip 58 of the stylus 55 projects outwardly through the bottom end of the sleeve 40, the cutting tip 58 is prevented from coming into contact with the ballot card 25 because of the abutment of the annular flange 42 on the upper end of the sleeve 40 with the bottom end of the top portion of the shank 50. This prevents the shank 50 from any further downward axial movement, thus providing a safety interlock which prevents holes from being punched in the ballot card 25 when the card is not properly inserted. The misaligned condition of the ballot card 25 is indicated by the large axial extent of the sleeve 40 above the upper surface of the top mask 15. Suitable indicia may be provided on the outer surface of the sleeve 40 for indicating the proper aligned reception of the sleeve 40 within the lockout template 30. This indicia may take the form of a circumferential line or groove on the outer surface of the sleeve 40 which is in alignment with the upper surface of the top mask 15 when the ballot card 25 is in the proper orientation.

Figure 6:
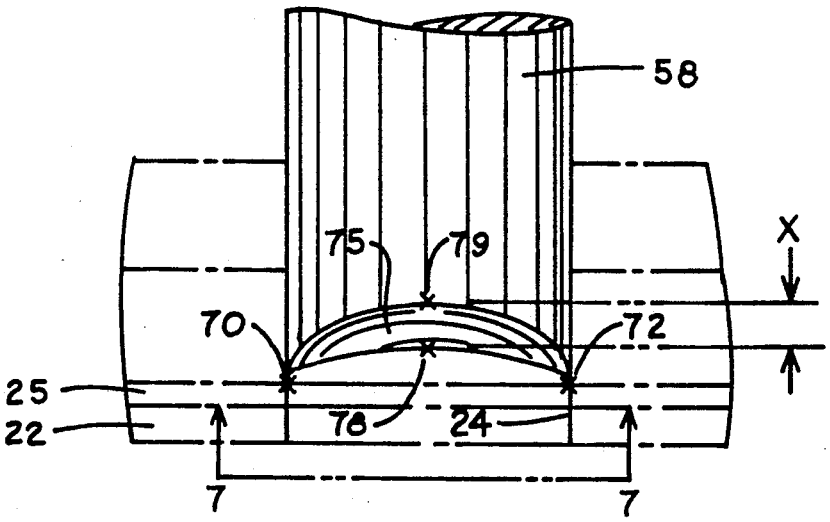
FIG. 6 is an enlarged diagrammatic side elevational view illustrating the progressive shearing action of the cutting tip of the punch stylus.
Figure 7:
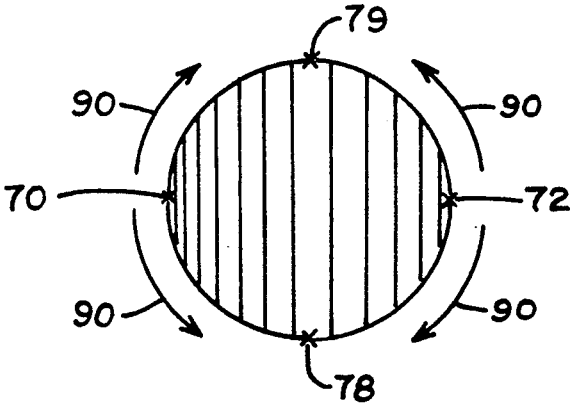
FIG. 7 is a bottom end view of the punch cutting stylus looking along line 7—7 of FIG. 6.

In FIG. 6, an enlarged diagrammatic side elevational view is provided, illustrating the construction of the cutting tip 58 of the cutting stylus 55. The bottom end of the cutting tip 58 is provided with a pair of opposed cutting tips 70 and 72 which are joined by curved cutting edges 78 and 79. The curved cutting edges 78 and 79 may be formed by a cylindrical milling tool having a central longitudinal axis which is positioned generally transversely to the longitudinal axis of the stylus 55, but is inclined from a horizontal line at an oblique angle to the longitudinal axis of the stylus 55, such that the curved cutting edges 78 and 79 are generated with an axial offset. The edges 78 and 79 are staggered along the axis of the stylus 55 a distance X, which is equal to or somewhat exceeds the thickness of the ballot card 25. For example, with cards which are 0.007 inches in thickness, the dimension X may be in the order of 0.010 inches, and the diameter of the stylus 55 may be of the order of 3/16 of an inch. When the cutting tips 70 and 72 simultaneously come into contact with the ballot card 25, they begin to penetrate the card and the cutting action proceeds along the peripheral curved edges 78 and 79 progresses from the tip contact regions 70 and 72 arcuately about the stylus in the direction of the arrows 90 in FIG. 7. Thus, upon penetration of the tips 70 and 72, cutting begins simultaneously at four points about the circumference of the cutting tip 58 and progresses about the circumference in the direction of the arrows 90 where they merge as the stylus completely severs a chip from the ballot card 25. The cutting action occurs along the shorter curved cutting edge 78 at a greater rate than along the longer curved cutting edge 79, and the edge 78 will penetrate the thickness of the card 25 while the longer curved cutting edge 79 is still cutting its one hundred and eighty degree quadrant through the card 25. This is due to the axial stagger of the cutting edges 78 and 79 which, in cooperation with the die openings 24 of the anvil plate 22, provides a progressive shearing action of a circular chip from the ballot card 25. This progressive shearing action results in a clean hole in the ballot card 25 which facilitates accurate scanning by a machine card reader. This progressive shearing action also provides a positive "pop" feel to the voter manipulating the punch 20, providing a positive indication of the shearing of the chip from the card 25. The chip 62 is completely severed from the card 25 and falls freely, obviating the necessity for employing an elastomer stripping plate or other chip stripping apparatus.

Figure 8:
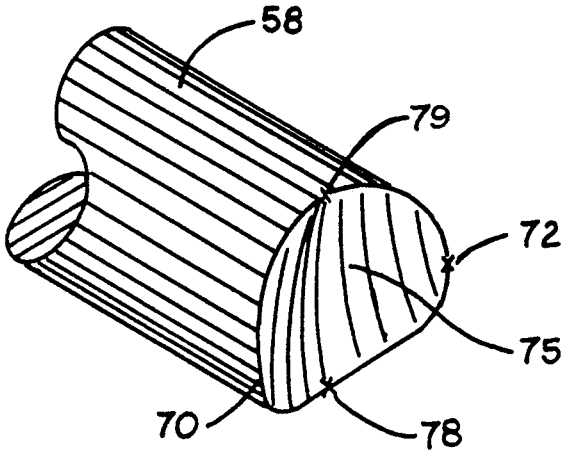
FIG. 8 is an enlarged perspective view illustrating the cutting tip of the punch stylus.

In FIG. 8, a perspective enlarged view of the cutting tip 58 is provided. The curved end surface 75 of the cutting tip 58 is generated by a cylindrical cutting tool extending at an angle with respect to the longitudinal axis of the stylus 55.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved vote recording device for forming a precise machine readable hole in a non-scored ballot card, comprising:

a punch shank adapted to be gripped by a voter; and an elongated punch stylus secured to said shank, said stylus terminating in a paper cutting tip, said tip having a concave recess formed in a distal end thereof, said recess having a generally cylindrical curvature on an axis which intersects a longitudinal axis of said stylus at an oblique angle, thereby forming a pair of axially staggered arcuate cutting edges.

2. The vote recording device of claim 1, wherein said arcuate cutting edges have an axial stagger at least equal to the thickness of the ballot card.

3. The vote recording device of claim 1, further comprising a tubular sleeve mounted within said punch shank in telescopic relation around said stylus, said sleeve mounted for limited reciprocal movement along a longitudinal axis of said shank between a first position in which said cutting tip is recessed within said sleeve and a second position in which said cutting tip projects outwardly of said sleeve, means biasing said sleeve into said first position, whereby an end of said sleeve is adapted to bear on a surface of the ballot card during punching by said stylus cutting tip to stabilize the ballot card.

4. The vote recording device of claim 1, wherein said arcuate cutting edges include a pair of diametrically opposed axially aligned cutting points.

5. A new and improved vote recording device for forming a precise machine readable hole in a non-scored ballot card, comprising:

a punch shank adapted to be gripped by a voter;

an elongated cylindrical punch stylus secured to said shank, said stylus terminating in a paper cutting tip, said tip having a concave recess formed in a distal end thereof, said recess having a generally cylindrical curvature positioned on an axis oblique to a longitudinal axis of said stylus, thereby forming a pair of axially staggered curved cutting edges, said curved cutting edges terminating in a pair of diametrically opposed cutting points.

6. The vote recording device of claim 5, in which the axial stagger of said curved cutting edges at least equals the thickness of the ballot card.

7. A punch for forming a hole in a ballot card, comprising:

a punch shank;

an elongated stylus extending from said shank;

a cutting tip formed on a distal end of said stylus, said tip having a concave recess formed in a distal end face thereof, said recess having a generally cylindrical curvature on an axis which intersects a longitudinal axis of said stylus at an oblique angle, thereby forming a pair diametrically opposed cutting points joined by axially staggered arcuate cutting edges.

8. The punch of claim 7, further comprising:

a tubular sleeve mounted on said shank in telescopic relation around said stylus, said sleeve mounted for limited axial reciprocal movement between a first position in which said cutting tip is recessed within said sleeve and a second position in which said cutting tip projects outwardly of said sleeve; and means biasing said sleeve into said first position.

9. An improved vote recording device for use with non-scored ballot cards, comprising:

a stationary bottom anvil plate having an array of spaced circular die openings;

a stationary top mask having an array of spaced circular punch access apertures in coaxial alignment with said die openings;

a lockout template having an array of spaced circular punch receiving openings received for limited sliding movement between said anvil plate and said top mask, said circular punch receiving openings having a diameter greater than the diameter of said die openings;

a slot for the receipt of a ballot card formed between said lockout template and said anvil plate;

a punch shank;

said punch shank having a cutting stylus extending therefrom;

said stylus having a cutting tip dimensioned to be inserted through said aligned openings to shear a chip out of a ballot card inserted over said anvil plate;

said punch shank having a tubular sleeve mounted in telescopic relation around said stylus, said sleeve having an outer diameter less than the diameter of said punch receiving openings and said punch access apertures and greater than the diameter of said die openings, said sleeve movable between a first position in which said sleeve encloses said cutting tip and a second position in which an open end of said sleeve abuts an inserted ballot card and coaxially surrounds one of said die openings and exposes a finite length of said stylus through said open end, said finite length being less than the thickness of said lockout template to prevent inadvertent engagement of said cutting tip with a ballot card whenever said lockout template is not fully aligned with said top mask.

10. The vote recording device of claim 9, further comprising means biasing said sleeve into said first position.

11. The vote recording device of claim 9, wherein said punch access apertures have a diameter slightly smaller than the diameter of said punch receiving openings.

12. The vote recording device of claim 11, wherein said cutting tip includes a concave recess formed in a distal end face thereof, said recess having a generally cylindrical curvature on an axis which intersects a longitudinal axis of said stylus at an oblique angle, thereby forming a pair of axially aligned diametrically opposed cutting points joined by axially staggered arcuate cutting edges.

13. The vote recording device of claim 12, wherein said arcuate cutting edges have an axial stagger at least equal to the thickness of an inserted ballot card.

14. The vote recording device of claim 9, further comprising spring means biasing said lockout template out of alignment with said top mask and a transverse end wall on said lockout template for abutment by an inserted ballot card to move said lockout template into alignment with said top mask upon proper insertion of the ballot card.

* * * * *